United States Patent [19]

Debus et al.

[11] Patent Number: 4,631,937

[45] Date of Patent: Dec. 30, 1986

[54] LOCK ASSEMBLY FOR CABINET DOORS

[75] Inventors: Jurgen Debus, Dietzholztal; Jugen Zachrai, Dillenburg; Helmut Butergerds, Eschenburg; Manfred Wetzel, Ewersbach, all of Fed. Rep. of Germany

[73] Assignee: Rittal-Werk Rudolf Loh GmbH & Co. KG, Fed. Rep. of Germany

[21] Appl. No.: 707,065

[22] Filed: Mar. 1, 1985

[30] Foreign Application Priority Data

Mar. 2, 1984 [DE] Fed. Rep. of Germany ..... 3407700

[51] Int. Cl.[4] ..... E05B 13/10

[52] U.S. Cl. ..... 70/207; 70/208; 70/211; 292/DIG. 31; 292/336.3; 292/39

[58] Field of Search ..... 70/208, 211, 467, 483–484, 70/489, 370–371, 451; 292/39, 142, 150, 172, 336.3, DIG. 31

[56] References Cited

U.S. PATENT DOCUMENTS

| | | | |
|---|---|---|---|
| 244,525 | 7/1881 | Barnes | 70/370 |
| 1,588,899 | 6/1926 | McCarthy | 292/172 |
| 1,995,338 | 3/1935 | Andrews | 292/DIG. 31 |
| 2,131,033 | 9/1938 | Barrington | 292/DIG. 31 |
| 2,164,150 | 6/1939 | Brewster | 292/DIG. 31 |
| 2,166,535 | 7/1939 | Sarenholm et al. | 292/39 |
| 2,223,236 | 11/1940 | Barrington | 70/208 |
| 2,246,708 | 6/1941 | Wieben | 70/208 |
| 2,253,257 | 8/1941 | Wellman | 292/172 |
| 2,377,301 | 5/1945 | Rolph | 70/208 |
| 2,570,160 | 10/1951 | Schoch | 70/208 |
| 2,750,217 | 6/1956 | Landholt | 292/DIG. 31 |
| 3,735,613 | 5/1973 | Dieber et al. | 70/208 |
| 3,745,796 | 7/1973 | Fleming | 70/81 |
| 4,132,092 | 1/1979 | Steinbach | 70/208 |
| 4,134,281 | 1/1979 | Pelcin | 70/208 |
| 4,370,874 | 2/1983 | Munn | 70/204 |
| 4,438,964 | 3/1984 | Peters | 70/208 |
| 4,480,451 | 11/1984 | Fujiya | 292/336.3 |
| 4,510,779 | 4/1985 | Ahad | 70/208 |

FOREIGN PATENT DOCUMENTS

| | | | |
|---|---|---|---|
| 7014950 | 4/1970 | Fed. Rep. of Germany . | |
| 8032588 | 6/1981 | Fed. Rep. of Germany . | |
| 3030519 | 2/1982 | Fed. Rep. of Germany | 292/336.3 |
| 2813677 | 9/1982 | Fed. Rep. of Germany . | |
| 200921 | 1/1966 | Sweden | 292/172 |

*Primary Examiner*—Gary L. Smith
*Assistant Examiner*—Suzanne L. Dino
*Attorney, Agent, or Firm*—Thomas W. Speckman

[57] ABSTRACT

A lock assembly for cabinet doors comprising a mounting plate attachable to the door panel and provided with a depression in its front face to receive a handle. The handle is connected to an operating shaft for a lock adjusting member in a spring loaded manner to cause the handle to be ejected from the depression pivoting about an axis perpendicular to the axis of rotation of the adjusting member. The hand lever is retained in and released from the depression by means of the lock assembly. The lock is installed in the mounting plate separate from the depression with the handle therein, and penetrates the door panel through an opening. The lock controls a slide adjustably disposed in the mounting plate by means of a detent element engaged in the depression, the detent element retaining the handle in the depression when the lock is in the locking position and releasing the handle which is ejected from the depression when the lock is in the unlocked position. This invention provides a lock assembly which has a small structural height, can easily be sealed, and has a conveniently and comfortably grippable handle.

22 Claims, 10 Drawing Figures

LOCK ASSEMBLY FOR CABINET DOORS

BACKGROUND OF THE INVENTION

1. Field of the Invention

The present invention relates to a lock assembly for switch cabinet doors and the like, comprising a mounting plate attachable to the door panel and having a depression in its front face for receiving a hand lever to be inserted flush with the surface of the mounting plate. The hand lever is connected to an operating shaft for the lock adjusting member so as to be pivotable about an axis perpendicular to the axis of rotation of the adjusting member. The operating shaft extends through the door panel and the mounting plate. The hand lever is retainable and releasable in the depression by means of a catch controlled by the lock.

2. Description of the Prior Art

A lock of this general type is disclosed in German Utility Model DE-GM No. 70 14 950. In this prior disclosure, a cylinder lock is installed in the free end of the hand lever. To avoid increasing the structural height of the lock mechanism using a cylinder lock, the lock projects free-floating through an opening in the door panel. This, however, leads to problems in the sealing of the lock, as indicated by German Utility Model DE-GM No. 80 32 588. Moreover, this arrangement may create problems because the hand lever with the cylinder lock attached thereto is inconvenience to grip and must be pulled out of the depression with the key of the cylinder lock. This is particularly disadvantageous if large torque forces must be transmitted by the hand lever to the operating shaft of the lock.

Also known are lock assemblies in which the cylinder lock is separate from the hand lever and is attached to the door panel as a separate component part in addition to the hand lever and its mounting plate, as disclosed by German Patent DE-PS No. 28 13 677. This door lock has a considerable structural height and protrudes substantially from the door panel, creating a permanent source of danger.

SUMMARY OF THE INVENTION

It is an object of the present invention to provide a door lock assembly of the type referred to above, which has a small structural height, presents no difficulties with regard to sealing, and utilizes a conveniently and comfortably grippable hand lever.

This is accomplished according to the present invention in that the lock penetrates the door panel at an opening and is installed in the mounting plate apart from a depression in the mounting plate and a hand lever, that the hand lever is spring loaded to bear against an operating shaft which causes the hand lever to be pivoted out of the depression, and that the lock controls a slide adjustable in the mounting plate by means of a detent element engaged in the depression, whereby the detent element retains the hand lever in the depression when the lock is in the locked position and releases the hand lever, allowing it to be ejected from the depression by the action of a compression spring when the lock is in the unlocked position.

Since the hand lever no longer accommodates a lock, it may be designed in an extremely grippable configuration. In the locking position, the hand lever rests in the depression flush with the surface of the mounting plate. When the lock installed in the mounting plate is unlocked, the slide, by its detent means, releases the hand lever. The hand lever is immediately ejected from the depression in the mounting plate by the action of the compression spring and can be gripped easily and comfortably for turning the operating shaft of the adjusting member. Since the position of the lock in the mounting plate never changes and the lock always projects through the door panel at the same position, this construction provides simple sealing. Because of the slight structural height of the lock in the locking position, the door lock does not pose a hazard to the environment.

One embodiment of the invention has been found to be particularly useful in which the lock is installed in an enlarged portion of the rectangular mounting plate, and this enlarged portion adjoins the pivotal upper end of the hand lever.

In order to reduce the effect that the hand lever pivotally connected to the operating shaft has on the structural height of the lock, another embodiment provides that the thickness of the hand lever is reduced on its reverse side where it is connected to the operating shaft, and a cutout is provided on the back of the hand lever at the connecting point, the end portion of the operating shaft projecting into the cutout, and the bearing pin for the pivotal mounting disposed in the cutout.

If, according to another embodiment, the slide is retained in the locked position by means of compression springs, the detent element projecting into a recess of the hand lever extends behind a detent projection in the recess of the hand lever and in the unlocked position of the lock, the slide is adjusted against the action of the compression springs by means of a cam provided on the lock in such a manner that the detent element releases the detent projection on the hand lever, and, upon release of the hand lever, the lock is ready again for immediate return to the locking position. When the hand lever thereupon returns to the depression in the mounting plate, the hand lever is automatically held therein when the construction is such that the detent element is in the form of a latch bolt having an annular groove and terminating in a cone-shaped latching tip at the end extending into the recess and facing the hand lever. The detent projection in the hand lever may comprise a latching pin disposed in a recess in the hand lever in such a manner that the latching pin engages the annular groove of a latch bolt when the hand lever is received in the depression and the slide has been released, i.e., in the locked position of the lock.

Adjustment of the slide and the detent element is implemented by means of the lock assembly according to another embodiment wherein the lock protrudes from the back side of the mounting plate in such a manner that a trip cam operatively engages an adjusting member on the slide which protrudes from the back of the mounting plate.

The slide may be installed in the mounting plate, according to another embodiment wherein the slide takes the form of a frame, so that the longitudinal members of the slide are adjustably guided in tracks provided on the back of the mounting plate, the frame encloses the operating shaft and a connecting rod adjusting member as well as the lock, while the transverse members of the slide frame are positioned in cutouts in the mounting plate, and are adjustable to a limited extent. The upper transverse portion of the frame may be constructed as an adjusting member and the lower transverse portion may comprise the detent element.

According to another embodiment, installation of a cylinder lock in the mounting plate is facilitated in that the enlarged portion of the mounting plate is provided with a through hole for receiving the cylinder lock, and that on the back of the mounting plate in the region of this hole, flanges for fastening the cylinder lock are provided.

According to another embodiment, the operating shaft extends through a guide block disposed on the back of the mounting plate and is connected to a connecting rod adjusting member in the form of a toothed wheel, and the side walls of a U-shaped guide member in combination with the longitudinal walls of the guide block define receiving spaces for connecting rods provided with toothed segments facing away from the lock mounting plate so that the connecting rods can engage directly with the connecting rod adjusting member, whereby they are guided and retained by the guide block and the U-shaped guide member.

The end portions of the connecting rods are preferably provided on their narrow sides with toothed segments, to adapt them for use on both left handed and right handed switch cabinet doors. To this end, the end portions of two identical connecting rods having toothed segments thereon are laterally offset by one-half of the width of the guide block, and the two end portions of the connecting rods, rotated by 180°, may be guided inside the two receiving spaces between the guide block and the side walls of the U-shaped guide member and mesh with a pinion comprising the connecting rod adjusting member. Alternatively, a continuous connecting rod may be employed which is provided in its mid section with a toothed segment laterally offset by one-half the width of the guide block. The teeth of the toothed segment are located on both of its two narrow sides. The connecting rod is insertable into one or the other of the two receiving spaces formed by the guide block and the side walls of the U-shaped guide member in two positions rotated by 180° and can readily be brought into engagement with the connecting rod adjusting member in the form of a pinion.

BRIEF DESCRIPTION OF THE DRAWINGS

The invention will be described in further detail with reference to specific embodiments illustrated in the drawings, wherein.

DESCRIPTION OF THE PREFERRED EMBODIMENTS

Figure 1:
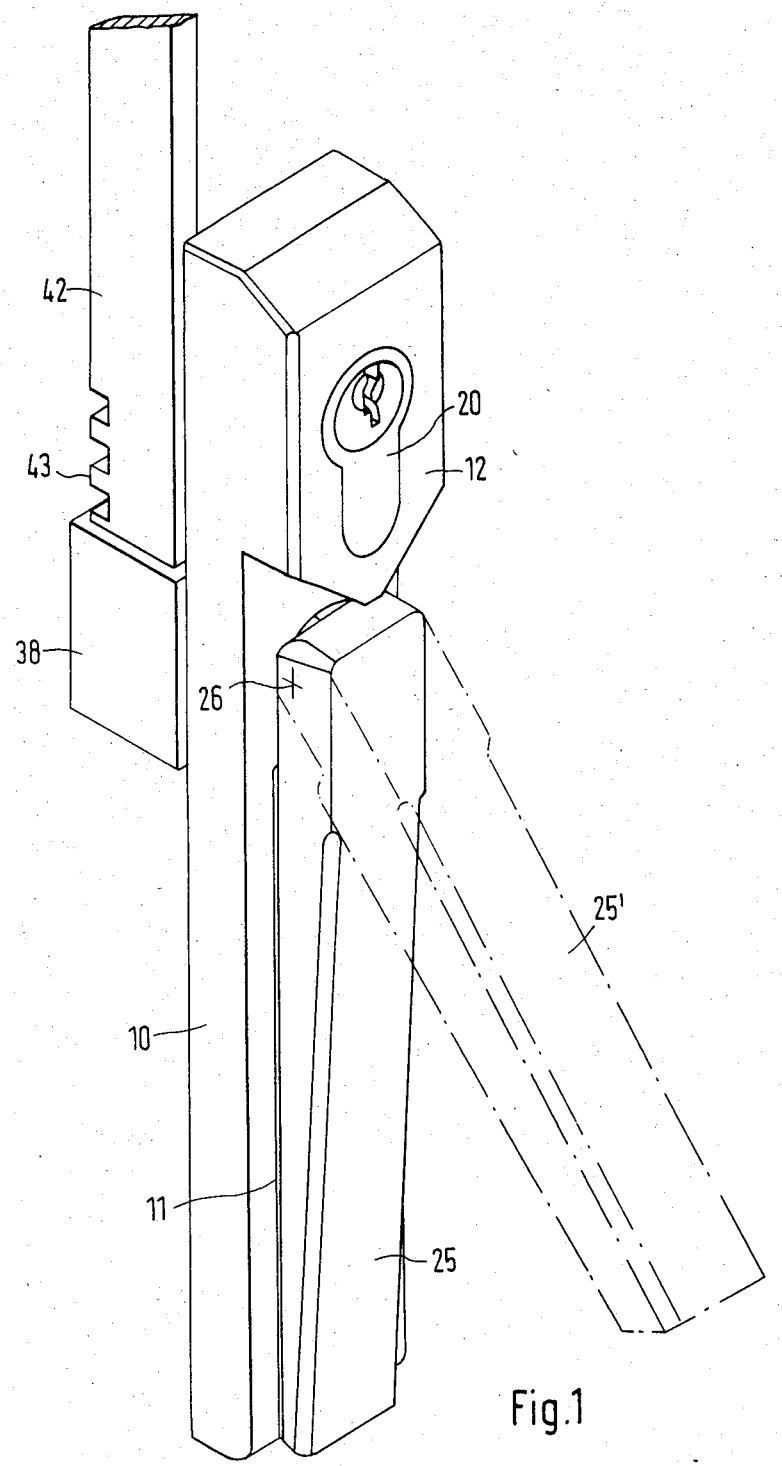
FIG. 1 is a perspective front view of a door lock assembly according to the present invention.
Figure 2:
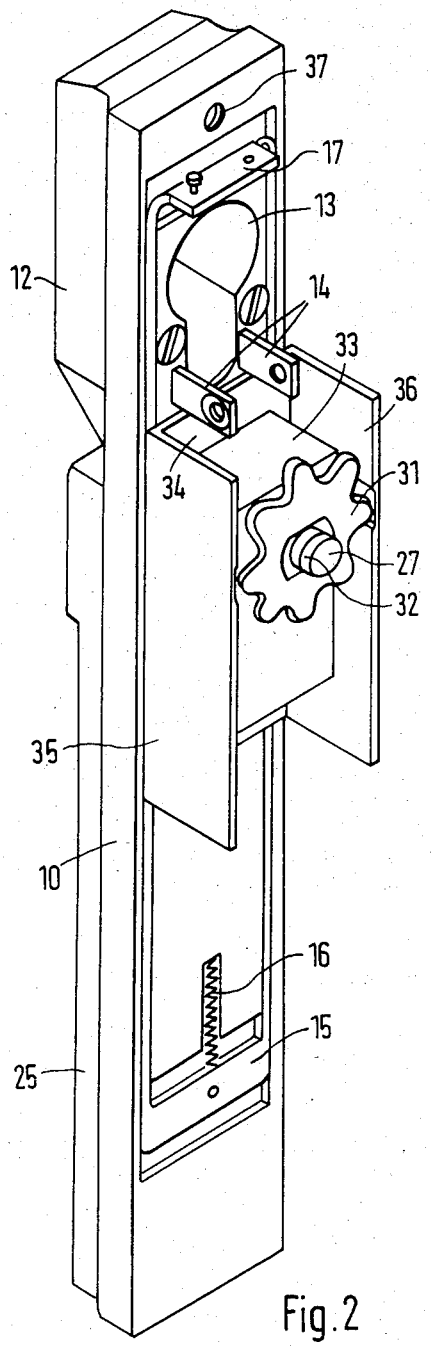
FIG. 2 is a perspective rear view of a door lock assembly with the connecting rods and the cylinder lock not yet installed.
Figure 3:
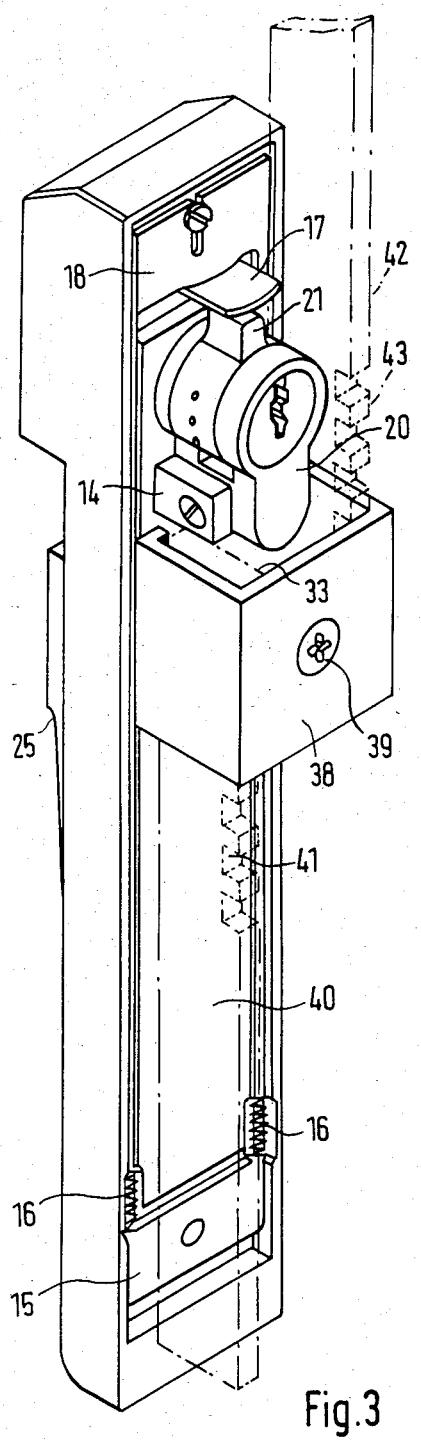
FIG. 3 is a perspective rear view of a door lock assembly, with a cylinder lock installed therein and two connecting rods indicated by dash-dotted lines.

Referring to the embodiment illustrated in FIGS. 1–3, lock mounting plate 10 is generally rectangular and is attachable to a door panel of a switch cabinet door or the like. A trough or depression 11 is provided in the front side of the mounting plate 10 for receiving a hand lever or handle 25 which rests within the depression and is flush with the mounting plate face. Mounting plate 10 is secured to the door panel so that the pivot end of handle 25 is at the top, as indicated by bearing bolt 26. Above handle 25, mounting plate 10 has an enlarged portion 12, the front of which is flush with handle 25 when it is positioned in depression 11 and latched therein. Cylinder lock 20 may be installed in enlarged portion 12 so it is flush on all sides.

Figure 4:
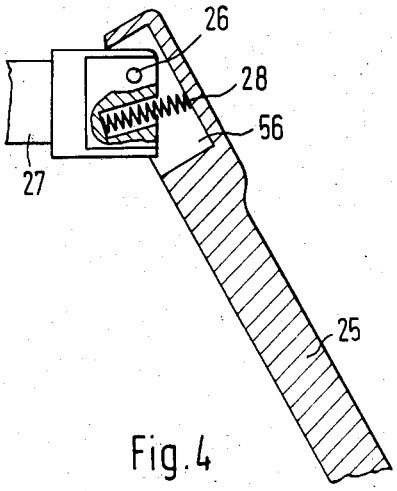
FIG. 4 is a view, partially in section, of the pivot point of the hand lever.
Figure 5:
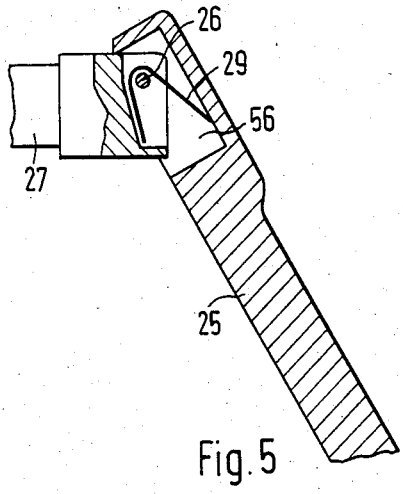
FIG. 5 is a view, partially in section, of the pivot point of the hand lever, employing a different type of spring.

As shown in FIG. 2, enlarged portion 12 is provided with a hole 13 to receive cylinder lock 20. Disposed on the back of enlarged portion 12 adjacent hole 13 are fastening flanges 14 to which cylinder lock 20 may be screwed as shown in FIG. 3. The upper end of handle 25 is slightly offset and of increased thickness, as shown in FIG. 1, and is provided on its back with cutout 56, as shown in FIGS. 4 and 5. Projecting into cutout 56 is the end portion of operating shaft 27 connected at its opposite end to connecting rod adjusting member 31. The upper end of handle 25 is pivotably engaged with the end of operating shaft 27 by means of bearing bolt 26 to enable handle 25 to be pivoted out of depression 11 in mounting plate 10, as indicated by the dash-dotted lines and the reference numeral 25' in FIG. 1. Operating shaft 27 extends through guide block 33 disposed on the back of mounting plate 10 or is integrally formed with it as a unitary piece. The longitudinal sides of guide block 33 face side walls 35 and 36 of U-shaped guide member 34. Together they form receiving spaces for connecting rods 40 and 42. Connecting rod adjusting member 31 comprises a toothed wheel or pinion mounted securely against rotation on the end of operating shaft 27 projecting from guide block 33. Pinion 31 is axially retained on operating shaft 27 by a safety washer fitted into annular groove 32, as is well known. Connecting rods 40, 42 are provided with toothed segments 41, 43, respectively, to mesh with pinion 31, causing connecting rods 40, 42 to move in opposite directions with respect to each other as shaft 27 and thereby pinion 31 is rotated. Rotation of operating shaft 27 is effected by handle 25 which is retained in depression 11 when the cylinder lock is in a locked position.

Figure 6:
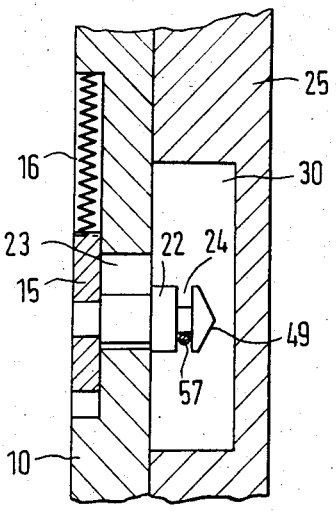
FIG. 6 is a view, partially in section, showing the locking of the hand lever by means of a latch bolt and locking pin.

As shown in the partially sectional view of FIG. 6, slide 15 with detent element 22 thereon is adjustably disposed in mounting plate 10. Detent element 22 projects through opening 23 in mounting plate 10 into depression 11. Handle 25 is provided with cutout 30 on the side facing the bottom of depression 11 and has disposed therein locking pin 57 which serves as a detent projection.

Detent element 22 comprising a latch bolt is provided with an annular groove 24 for engagement with locking pin 57 when handle 25 is retained in depression 11. For this purpose, the end of the latch bolt facing handle 25 is provided with cone-shaped latching tip 49.

Slide 15 may be constructed in the form of a frame, the longitudinal members of which are adjustably guided in recesses provided on the back of mounting plate 10. The slide frame 15 is adjustably engaged with mounting plate 10 by compression springs 16 in a manner such that it is being pulled toward the locking position. For this purpose, one or two compression springs 16 may be used, as shown in FIGS. 2 and 3. Supported on the bottom portion of the slide frame, detent element 22 is mounted facing handle 25 and extends through opening 23 into depression 11. Top portion 18 of the slide frame may form an adjusting member 17 projecting from the back of mounting plate 10 and adapted to operatively engage with trip cam 21 of cylinder lock 20. In the unlocked position shown in FIG. 3, cam 21 of cylinder lock 20 operates by the action of compression springs, to raise adjusting member 17 and thus slide frame 15. Simultaneously the latch bolt is axially displaced an amount sufficient to release the locking pin, and handle 25 swings into the operating position indicated at 25'. Compression spring 28 may be in the form of a spiral spring and bear against the wall of a blind hole in the end section of the shaft 27 and the interior of cutout 56 in handle 25 so that handle 25, released by detent element 22 attached to slide frame 15, is automatically ejected from depression 11, as shown in FIG. 4. Compression spring 29 shown in FIG. 5 comprises a V-shaped leaf spring, the legs of which bear against a recess in the front end of operating shaft 27 and the interior wall of cutout 56 in handle 25.

Figures 9, 10:
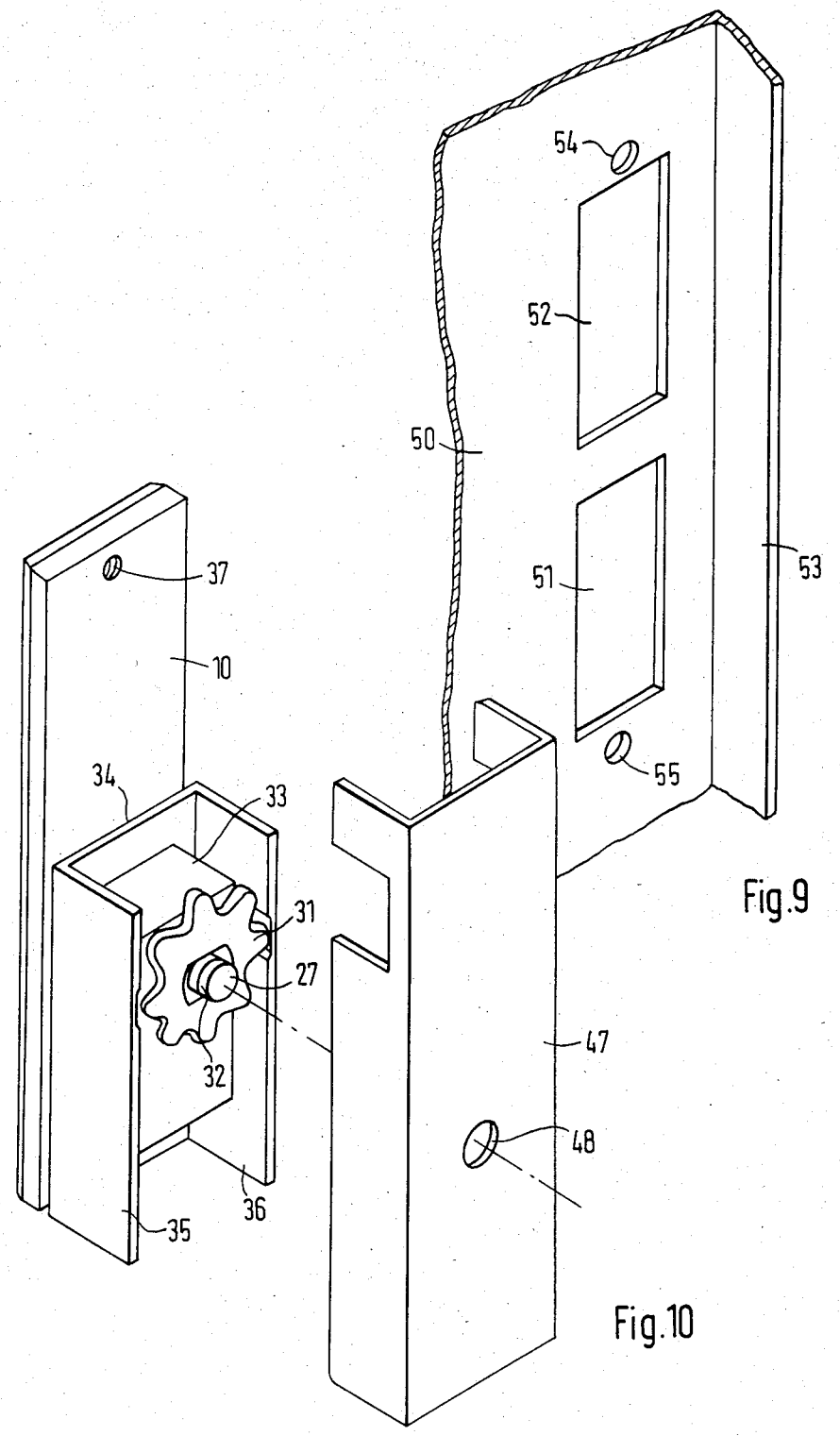
FIG. 9 shows a door panel in which the lock assembly of this invention may be installed.
FIG. 10 is a perspective exploded view showing a cover cap.

Mounting plate 10 may have threaded bores 37 for attachment to door panel 50, as shown in FIG. 9. Door panel 50 has a right angled edge 53 and mounting holes 54 and 55. Rectangular openings 51, 52 permit operating shaft 27, guide block 33 and cylinder lock 20 to pass through the door panel. Guide block 33 may be covered by U-shaped cap 38, as shown in FIG. 3, attached to guide block 33 by screw 39. In this case, the side walls of U-shaped cap 38 and the longitudinal sides of guide block 33 form receiving spaces for connecting rods 40, 42 which are rectangular in cross section and are installed on edge.

Figure 7:
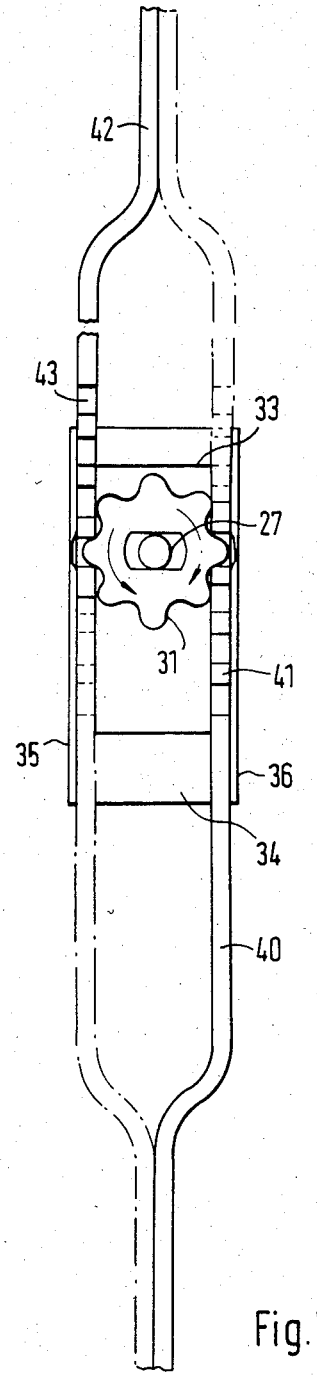
FIG. 7 shows schematically the operative interaction between the connecting rod adjusting member comprising a pinion and two identical connecting rods, solid lines indicating one positioning of the connecting rods, and dash-dotted lines indicating an alternative positioning.

As shown in FIG. 7, identically constructed connecting rods 40, 42 may be installed on right-handed as well as left-handed switch cabinet doors, if the end sections of the connecting rods 40, 42 have toothed segments 41, 43, respectively, on both of their narrow sides and if these end sections are laterally offset by one-half of the width of guide block 33. Connecting rods 40, 42 installed in the position shown in FIG. 7 move downwardly and upwardly, respectively, as connecting rod adjusting member 31 is rotated clockwise, and move in the opposite directions when adjusting member 31 is rotated counterclockwise. If connecting rods 40, 42 are installed in the position indicated by dash-dotted lines, they move upwardly or downwardly, respectively, as adjusting member 31 is rotated clockwise while, again, they move in the opposite directions as adjusting member 31 is rotated counterclockwise. In any case, connecting rods 40, 42 rest on edge, and remain oriented relative to the center axis of the door lock. Thus, both connecting rods 40, 42 may be employed as the handedness of a particular switch cabinet door may require.

Figure 8:
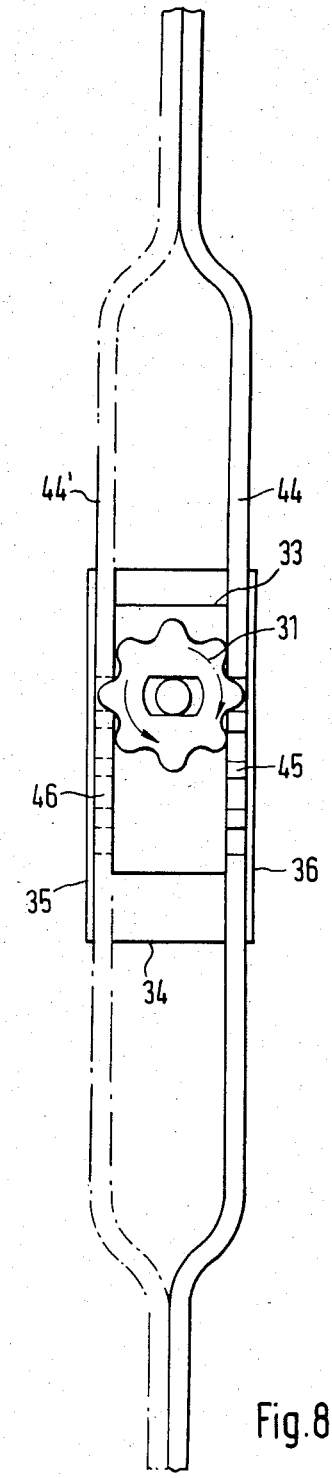
FIG. 8 shows schematically the operative interaction between a continuous connecting rod and the connecting rod adjusting member comprising a pinion, solid lines indicating one positioning of a connecting rod, and dash-dotted lines indicating an alternative positioning.

The same is true of the door lock assembly shown in FIG. 8, in which continuous or "through" connecting rod 44 is employed. Again, connecting rod 44 is provided with teeth 45 and 46 on each of its two narrow sides. The toothed section of connecting rod 44 again is laterally offset by one-half of the width of guide block 33. Connecting rod 44 may be rotated by 180° as shown by the dash-dotted lines and selectively introduced into one or the other of the receiving spaces formed by side walls 35 and 36 of U-shaped guide member 34 and an appropriate cover cap. The upper toothed segment 45 or 46 meshes with pinion 31 comprising the connecting rod adjusting member. In either case, the alignment of connecting rod 44 relative to the center of the door lock assembly is preserved.

Operating shaft 27 may be coupled to an adjusting member of a different kind to which connecting rods are linked by adjusting levers or the like. Moreover, the door lock assembly is also suitable for use with rotary rods. In this case, the revolving motion of operating shaft 27 is translated into a revolving motion for rotary rods, which may be implemented by coupling elements well known to the art.

In the embodiment described, the door lock assembly utilizes cylinder lock 20. However, it is within the scope of the invention to employ other operative means, such as triangular or square locks for installation in mounting plate 10, which lock mechanisms are equally capable of adjusting slide 15.

To protect the lock from the environment, a further embodiment provides for a cover cap to be slidably positioned on enlarged section 12 of mounting plate 10 for selectively covering or uncovering the lock. The cover cap may also be hinged to enlarged section 12 of mounting plate 10 so as to alternatively cover or uncover the lock by a flapping motion.

The cover cap may moreover serve to protect the door lock assembly against dust and moisture.

We claim:

1. Lock assembly apparatus for cabinet doors comprising a mounting plate (10) attachable to a door panel (50), said mounting plate (10) having a vertically extending depression (11) in its front face sized to receive a hand lever (25) retainable in and releasable from said depression (11), said hand lever (25) spring loaded with a spring (28) capable of pivotally ejecting said hand lever (25) from said depression (11), said hand lever (25) pivotably connected to a rotatable operating shaft (27) of said lock assembly extending through said mounting plate (10) and extendable through said door panel (50), said hand lever (25) pivotable about an axis perpendicular to the axis of rotation of said operating shaft (27); a lock means (20) extendable through an opening (52) in said door panel (50) and installed in said mounting plate (10) separate from said depression (11) and said hand lever (25), said lock means (20) controlling a slide (15) adjustably disposed in said mounting plate (10) which releases said hand lever (25) from and retains said hand lever (25) in said depression (11) by means of a detent element (22) projecting into a cutout (30) in said hand lever (25) facing said depression (11), said detent element (22) provided with an annular groove (24) and a terminal cone-shaped latching tip (49) and said cutout (30) provided with a detent projection (57), said annular groove (24) of said detent element (22) urged by said slide (15) to engage said detent projection (57) to retain said hand lever (25) in said depression (11) when said lock means (20) is in a locked position, and said slide

(15) releasing said annular groove (24) of said detent element (22) from said detent projection (57) to release said hand lever (25) from said depression (11) by the action of said spring (28) when said lock means (20) is in an unlocked position.

2. Lock assembly apparatus according to claim 1, wherein said lock means (20) is disposed in an enlarged section (12) of a rectangular said mounting plate (10) adjoining the upper end of said hand lever (25).

3. Lock assembly apparatus according to claim 2, wherein said hand lever (25) is provided with a cutout section (56) on its side facing said mounting plate (10) in the region where it is connected to said operating shaft (27).

4. Lock assembly apparatus according to claim 3, wherein said slide (15) is urged by slide compression springs (16) to attain said locked position in which said annular groove (24) of said detent element (22) engages said detent projection (57) on said hand lever (25) in said depression (11), and said slide (15) is urged by means of a cam (21) provided on said lock means (20) against the action of said slide compression springs (16) when said lock means (20) is in said unlocked position to release said annular groove (24) of said detent element (22) from said detent projection (57), thereby releasing said hand lever (25) to attain said unlocked position.

5. Lock assembly apparatus according to claim 4, wherein said lock means (20) protrudes from the back of said mounting plate (10) in such a manner that said cam (21) operatively engages an adjusting member (17) provided on said slide (15).

6. Lock assembly apparatus according to claim 5, wherein an end of said operating shaft (27) extends into said cutout section (56) and is attached to said hand lever (25) by a bearing bolt (26) to provide pivotability of said hand lever (25).

7. Lock assembly apparatus according to claim 6, wherein said slide (15) is slidably guided in recesses provided on the back of said mounting plate (10), and said operating shaft (27) penetrates said slide (15) and is attached to a connecting rod adjusting member (31).

8. Lock assembly apparatus according to claim 7, wherein said slide (15) is provided with an upper transverse member (18) which comprises said adjusting member (17), and said slide (15) is provided with a lower transverse member which comprises said detent element (22).

9. Lock assembly apparatus according to claim 8, wherein said enlarged section (12) of said mounting plate (10) is provided with a through hole (13) for retaining said lock means (20) comprising a cylinder lock, and that fastening flanges (14) for securing said cylinder lock (20) are provided on the back of said mounting plate (10) in the area of said hole (13).

10. Lock assembly apparatus according to claim 9, wherein a guide block (33) and a U-shaped guide member (34) are provided on the back of said mounting plate (10), said operating shaft (27) penetrates said guide block (33) and is fixedly mounted to said connecting rod adjusting member (31) which comprises a pinion; and side walls (35, 36) of said U-shaped guide member (34) in combination with two longtidinal sides of said guide block (33) define receiving spaces for at least one connecting rod (40, 42, 44) extending longitudinally and provided with toothed segments (41, 43, 45, 46).

11. Lock assembly apparatus according to claim 10, wherein said at least one connecting rod (40, 42, 44) is provided on two sides with toothed segments (41, 43, 45, 56).

12. Lock assembly apparatus according to claim 11, wherein two identical connecting rods (40, 42) having toothed segments (41, 43) thereon are provided and are laterally offset by one-half of the width of said guide block (33), and that the ends of said connecting rods (40, 42) are rotated by 180° and guided within said receiving spaces fromed between said guide block (33) and said side walls (35, 36) of said U-shaped guide member (34), said toothed segments (41, 43) of said connecting rods (40, 42) adapted to mesh with said pinion (31) comprising said connecting rod adjusting member whereby as said pinion (31) rotates, said connecting rods (40, 42) move longitudinally in opposite directions with respect to one another.

13. Lock assembly apparatus according to claim 11, wherein a single continuous connecting rod (44, 44') is provided in its mid-section with a toothed segment laterally offset by one-half of the width of said guide block (33) and toothed segments (45, 46) on each of two sides, said connecting rod (44, 44') rotatable by 180° into two positions for insertion into one of the other of said receiving spaces formed by said guide block (33) and said side walls (35, 36) of said U-shaped guide member (34) and operatively engaged with said pinion (31) comprising said connecting rod adjusting member.

14. Lock assembly apparatus according to claim 2, wherein said lock means (20) is covered by a cover cap mounted on said enlarged section (12) of said mounting plate (10).

15. Lock assembly apparatus according to claim 1, wherein said hand lever (25) is provided with a cutout section (56) on its side facing said mounting plate (10) in the region where it is connected to said operating shaft (27).

16. Lock assembly apparatus according to claim 1, wherein said lock means (20) protrudes from the back of said mounting plate (10) in such a manner that a cam (21) provided on said lock means (20) operatively engages an adjusting member (17) provided on said slide (15) when said lock means (20) is in said unlocked position.

17. Lock assembly apparatus according to claim 1, wherein said hand lever (25) is provided with a cutout section (56) facing said depression (11) into which an end of said operating shaft (27) extends and is attached to said hand lever (25) by a bearing bolt (26) to provide pivotability of said hand lever (25).

18. Lock assembly apparatus according to claim 1, wherein said slide (15) is slidably guided in recesses provided on the back of said mounting plate (10), and said operating shaft (27) penetrates said slide (15) and is attached to a connecting rod adjusting member (31).

19. Lock assembly apparatus according to claim 18, wherein a guide block (33) and a U-shaped member (34) are provided onthe back of said mounting plate (10), said operating shaft (27) penetrates said guide block (33) and is fixedly mounted to said connecting rod adjusting member (31) which comprises a pinion; and side walls (35, 36) of said U-shaped guide member (34) in combination with two longitudinal sides of said guide block (33) define receiving spaces for at least one connecting rod (40, 42, 44) extending longitudinally and provided with toothed segments (41, 43, 45, 46).

20. Lock assembly apparatus according to claim 19, wherein two identical connecting rods (40, 42) having toothed segments (41, 43) thereon are provided and are laterally offset by one-half of the width of said guide block (33), and that the ends of said connecting rods (40, 42) are rotated by 180° and guided within said receiving spaces formed between said guide block (33) and said side walls (35, 36) of said U-shaped guide member (34), said toothed segment (41, 43) of said connecting rods (40, 42) adapted to mesh with said pinion (31) comprising said connecting rod adjusting member whereby as said pinion (31) rotates, said connecting rods (40, 42) move longitudinally in opposite directions with respect to one another.

21. Lock assembly apparatus according to claim 19, wherein a single continuous connecting rod (44, 44') is provided in its mid-section with a toothed segment laterally offset by one-half of the width of said guide block (33) and toothed segments (45, 46) on each of two sides, said connecting rod (44, 44') rotatably by 180° into two positions for insertion into one or the other of said receiving spaces formed by said guide block (33) and said side walls (35, 36) of said U-shaped guide member (34) and operatively engaged with said pinion (31) comprising said connecting rod adjusting member.

22. Lock assembly apparatus according to claim 2, wherein said enlarged section (12) of said mounting plate (10) is provided with a through hole (13) for retaining said lock means (20) comprising a cylinder lock, and that fastening flanges (14) for securing said cylinder lock (20) are provided on the back of said mounting plate (10) in the area of said hole (13).

* * * * *